US006589012B2

(12) United States Patent
Burnett et al.

(10) Patent No.: US 6,589,012 B2
(45) Date of Patent: Jul. 8, 2003

(54) METHOD AND APPARATUS FOR ELIMINATING THERMAL BOWING USING BRUSH SEALS IN THE DIAPHRAGM PACKING AREA OF STEAM TURBINES

(75) Inventors: Mark Edward Burnett, Buskirk, NY (US); Christopher Edward Wolfe, Schenectady, NY (US); Frederick George Baily, Ballston Spa, NY (US); Norman Arnold Turnquist, Sloansville, NY (US); Bruce William Brisson, Galway, NY (US); David Alan Caruso, Ballston Lake, NY (US)

(73) Assignee: General Electric Company, Schenectady, NY (US)

( * ) Notice: Subject to any disclaimer, the term of this patent is extended or adjusted under 35 U.S.C. 154(b) by 78 days.

(21) Appl. No.: 09/960,672

(22) Filed: Sep. 24, 2001

(65) Prior Publication Data

US 2003/0059298 A1 Mar. 27, 2003

(51) Int. Cl.[7] ..... F01D 11/12

(52) U.S. Cl. ..... 415/174.2; 415/174.5; 415/231

(58) Field of Search ..... 415/174.2, 174.5, 415/173.4, 176, 231

(56) References Cited

U.S. PATENT DOCUMENTS

| | | | |
|---|---|---|---|
| 4,415,309 | A | 11/1983 | Atterbury |
| 4,756,536 | A | 7/1988 | Belcher |
| 5,026,252 | A | 6/1991 | Hoffelner |
| 5,351,971 | A | 10/1994 | Short |
| 5,474,305 | A | 12/1995 | Flower |
| 5,474,306 | A | 12/1995 | Bagepalli |
| 5,749,584 | A | 5/1998 | Skinner et al. |
| 6,168,377 | B1 | 1/2001 | Wolfe et al. |

FOREIGN PATENT DOCUMENTS

| | | |
|---|---|---|
| GB | 2 191 825 | 12/1987 |
| GB | 2 301 635 | 12/1996 |

*Primary Examiner*—Edward K. Look
*Assistant Examiner*—Kimya N McCoy
(74) *Attorney, Agent, or Firm*—Nixon & Vanderhye

(57) ABSTRACT

In a steam turbine, a combined brush and labyrinth seal is provided between a diaphragm web and a sealing surface on a rotatable component radially outwardly of the rotor surface. The contact between the brush seal and sealing surface lies along an axially upstream projecting flange of an annular platform such that heat generated by frictional contact between the bristles and the sealing surface has minimal effect on the rotor surface and hence rotor dynamics. A backup labyrinth seal is provided between the web and platform. Additionally, axially upstream projecting flanges are provided on the downstream buckets and which flanges are spaced radially outwardly of the rotor surface and lie in registration with the diaphragm web. Labyrinth teeth seal between the diaphragm web and the bucket flanges serving as a backup seal.

10 Claims, 2 Drawing Sheets

METHOD AND APPARATUS FOR ELIMINATING THERMAL BOWING USING BRUSH SEALS IN THE DIAPHRAGM PACKING AREA OF STEAM TURBINES

BACKGROUND OF THE INVENTION

The present invention relates to a steam turbine having brush seals between non-rotatable and rotatable components arranged and located to eliminate thermal bowing resulting from non-uniform distribution of heat about the rotatable component due to frictional contact between the brush seal and the rotatable component and particularly relates to apparatus and methods for eliminating axial thrust loads in the event of failure of the brush seal in such turbine.

In U.S. Pat. No. 6,168,377, of common assignee herewith, there is disclosed a steam turbine having a brush seal located between a non-rotatable component and a rotatable component of the rotor shaft. Particularly, axial flanges are provided on the dovetails of the buckets, the bucket dovetails being secured in complementary fashion to the dovetail of a rotor wheel. A brush seal comprised of an arcuate array of metal bristles projecting from the non-rotatable component toward the rotatable component, i.e., the flanges on the bucket dovetails, has bristle tips engaging with and bearing against the flange surfaces. As will be appreciated from a review of that patent, the contact between the bristles of the brush seal and the opposing sealing surface, i.e., the flanges, generates heat.

As disclosed in that patent, it is recognized that the contact between the brush seal and the sealing surface should be located radially outwardly of the rotor shaft in order to isolate the generated heat from the outer diameter of the rotor. Otherwise, the friction-generated heat may cause a non-uniform temperature distribution about the circumference of the shaft, resulting in non-uniform axial expansion of the rotor and, hence, a bow in the rotor. While various methods and apparatus are disclosed in that patent for eliminating that problem, one such solution locates the friction-generating surface on the bucket dovetail flanges radially outboard of the outer shaft diameter. In that manner, the generated heat is isolated from the rotor, eliminating any tendency of the rotor to bow.

That patented design and other designs utilize conventional labyrinth-type packing seals on the inside of the diaphragm web as a backup to the brush seal. These labyrinth seals are located directly adjacent the outer diameter of the shaft. Brush seals are, however, susceptible to wear and failure. Should a brush seal spaced outwardly from the shaft fail, e.g., the brush seal of that patented design, the sealing diameter changes from the bucket dovetail platform to the rotor shaft. This, in turn, adversely changes the pressure distribution on the shaft and the thrust on the rotor in an axial direction. Accordingly, there is a need to provide a sealing system for a steam turbine in which not only is the problem of thermal bowing of the steam turbine rotor due to non-uniform heat distribution resulting from contact between brush seals and complementary sealing surfaces eliminated, but also the axial thrust loads on the rotor bearings are eliminated or minimized in the event of brush seal failure.

BRIEF SUMMARY OF THE INVENTION

In accordance with a preferred embodiment of the present invention, there is provided a brush seal located radially outwardly of the outer diameter of the shaft of the rotatable component to eliminate thermal bowing of the rotor due to non-uniform heat distribution in combination with a labyrinth seal at substantially the same radial location to eliminate thrust loads in the event of failure of the brush seal. To accomplish the foregoing, the rotatable component, i.e., the rotor shaft, has an annular rim or platform projecting radially outwardly into the wheelspace between axially adjacent wheels. The platform is in the form an annular pedestal having a neck and a flange or fin extending axially toward the axially opposed wheel at the radially outer extremity of the pedestal. It will be appreciated that the platform extends into the wheelspace defined between the axially adjacent wheels and the stationary component.

The flange or fin on the platform has an annular sealing surface for engagement by the bristle tips of an annular brush seal carried by the web of the diaphragm. With the flange or fin thus cantilevered in an axial direction and defining the sealing surface, it will be appreciated that for heat generated by frictional contact between the bristles and the sealing surface to affect rotor dynamics, the heat must traverse first axially along the flange or fin and then radially inwardly toward the rotor. This geometry enables the heat generated by the frictional contact of the bristles on the sealing surface to be substantially dissipated or dissipated to the extent that rotor dynamics are not affected by any heat generated by contact between the brush seal and sealing surface.

Additionally, a labyrinth seal is also provided in the wheelspace. Particularly, the upstream or downstream buckets have flanges which project into the wheelspace in an axial direction. In radial registration with the bucket flanges are one or more labyrinth seal teeth carried by the surrounding annular web. These labyrinth seal teeth cooperable with the bucket dovetails are provided to mitigate steam turbine section performance degradation in the event of brush seal failure. The labyrinth teeth carried by the web may also lie on the upstream or downstream sides or on both sides of the brush seal and cooperate with the rotor platform flange to provide the backup seal. The matched radial location of the brush and labyrinth seals about the rotor wheels also mitigates the effect on rotor thrust in the event of brush seal failure. As a consequence, the foregoing described design enables application of brush seals to all stages of the diaphragm packing area within current brush seal application limitations.

In a preferred embodiment according to the present invention, there is provided a steam turbine comprising a rotatable component including a rotor shaft and a non-rotatable component about the rotatable component, a brush seal carried by the non-rotatable component for sealing engagement with the rotatable component, first and second wheels on the rotatable component spaced axially from one another, the rotatable component including a plurality of buckets spaced circumferentially from one another on each of the wheels, means for inhibiting non-uniform circumferential heat transfer to the rotatable component thereby to eliminate or minimize bow of the rotatable component due to frictional contact between the brush seal and the rotatable component, the inhibiting means including an annular platform projecting radially outwardly of an outer surface of and from the rotor shaft at an axial location between the first and second wheels, flanges extending axially from the buckets on the second wheel in a direction toward the platform and the first wheel and spaced radially outwardly of the outer surface of the rotor shaft, the brush seal disposed between the buckets and engaging a sealing surface on the platform radially outwardly of the outer surface and at least one labyrinth seal tooth extending between the stationary component and the bucket flanges.

In a further preferred embodiment according to the present invention, there is provided in a steam turbine having a rotatable component including a rotor shaft mounting axially spaced buckets and a non-rotatable component about the rotatable component carrying a brush seal for sealing engagement with the rotatable component, a method of substantially eliminating bowing of the rotor resulting from circumferentially non-uniform distribution of heat about the rotatable component due to frictional contact between the brush seal and the rotatable component comprising the steps of inhibiting circumferential non-uniform heat transfer to the rotatable component resulting from heat generated by frictional contact between the rotatable component and the brush seal by locating the brush seal radially outwardly of the rotor shaft for sealing a steam leakage path between the rotatable and non-rotatable components, providing upstream directed flanges on the buckets downstream of the brush seal and radially outwardly of the rotor shaft and locating a labyrinth seal on the non-rotatable component for sealing cooperation with a sealing surface on the flanges at substantially the same radial distance from the shaft as the brush seal.

DETAILED DESCRIPTION OF THE INVENTION

Figure 1:
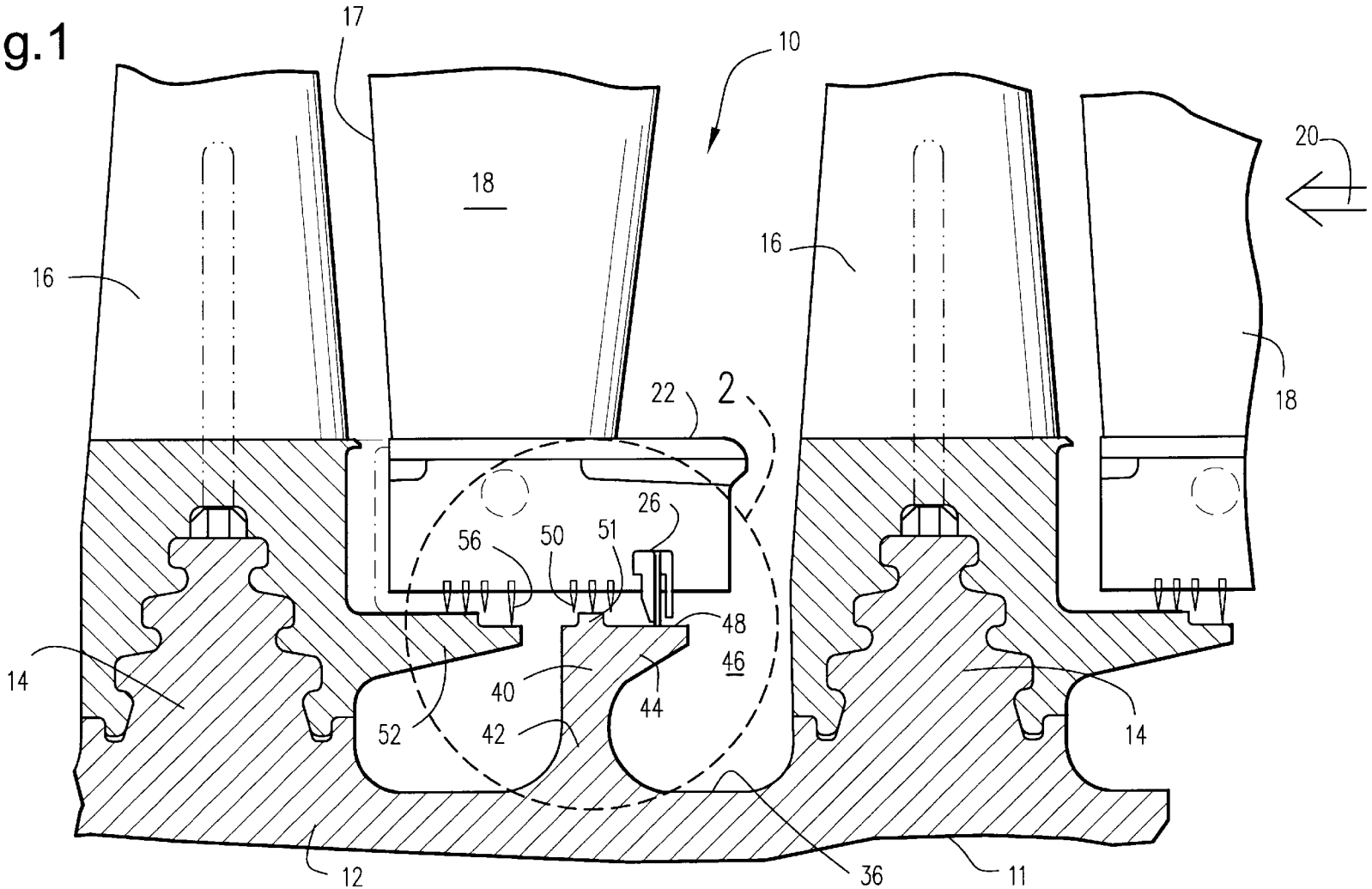
FIG. 1 is a schematic cross-sectional view of a portion of a steam turbine illustrating turbine buckets and diaphragms along the turbine shaft and the locations of the brush and labyrinth seals.

Referring now the drawings, particularly to FIG. 1, there is illustrated a steam turbine, generally designated 10, having a rotatable component 11, e.g., a rotor or shaft 12, mounting a plurality of axially spaced wheels 14 mounting buckets 16, first and second axially adjacent wheels 14 being illustrated. As used herein, the first and second wheels refer to any pair of axially adjacent wheels of the turbine and do not necessarily refer to the wheels of the first and second stages of the turbine, respectively. A non-rotatable or stationary component 17 is provided. Component 17 includes a plurality of nozzle partitions 18 are interspersed between the buckets and form with the buckets 16 a steam flow path indicated by the arrow 20. The partitions 18 are attached to a diaphragm inner web 22 extending between the wheels 14 of the stages of the turbine. It will be appreciated that the rotor 12 is a continuous solid elongated piece of metal.

Figure 2:
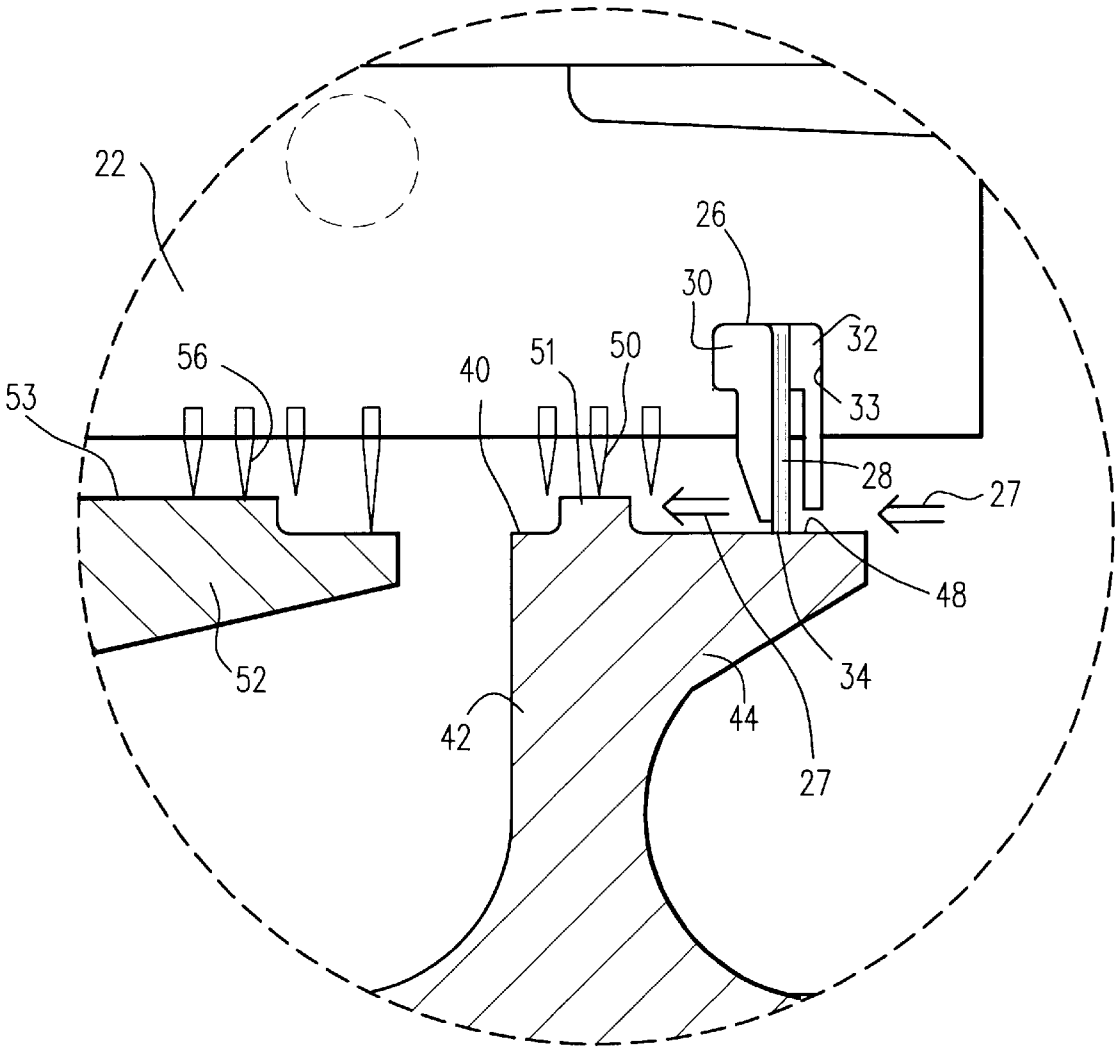
FIG. 2 is an enlarged fragmentary cross-sectional view taken within the circle designated 2 in FIG. 1 illustrating a combined brush and labyrinth seal and sealing surfaces therefor.

As illustrated in FIG. 1, a brush seal 26 seals between the stationary component, for example, the web 22, and the rotatable component 12 along a leakage flow path, indicated by the arrow 27 in FIG. 2, in communication with the steam flow path 20. Referring to FIG. 2, the brush seal 26 includes a plurality of preferably metal bristles 28 disposed between a pair of plates 30 and 32 extending circumferentially about the rotor 12. The plates 30 and 32 are disposed in an annular slot 33 formed in the web 22.

To prevent non-uniform distribution of heat about the rotor due to frictional contact between the tips of the bristles 28 and the rotatable component, i.e., rotor 12, the contact between the bristle tips 34 and the rotatable component 12 is disposed at a location radially outwardly of the surface 36 of the rotor 12 and at an axial location wherein heat generated by frictional contact between the bristle tips and the sealing surface of the rotor dissipates both axially and radially before affecting rotor dynamics. To accomplish this, the rotatable component is provided with an annular radially projecting platform 40 in the form of an annular projecting rim or pedestal having a neck 42 and an axially projecting annular flange or fin 44. As illustrated, the flange or fin 44 projects in an axially upstream direction vis-a-vis the direction of flow of the steam along the flow path 20, although it may also project in a downstream direction. From a review of FIG. 1, it will be appreciated that a portion of the wheelspace 46 which receives the fin or flange 44 lies between the fin or flange 44 and the surface 36 of the rotor shaft 12. More particularly, the contact between the bristle tips 34 and the sealing surface 48 on the flange 44 lies radially outwardly of the rotor shaft surface 36 and axially forwardly of the neck 42. Consequently, heat generated by the frictional contact between the bristle tips 34 and the sealing surface 48 dissipates first in an axial direction and then in a radially inward direction along neck 42 and therefore little or no heat transfer onto the rotor surface 36 takes place. The geometry, i.e., configuration of the platform 42 is therefore such that the heat generated by the frictional contact of the brush bristles on the sealing surface of the platform is dissipated substantially entirely before affecting the rotor and rotor dynamics.

Backup labyrinth seal teeth 50 are provided on the web 22. The one or more labyrinth teeth 50 project radially inwardly from the web 22 and terminate short of a further sealing surface 51 along the annular outer surface of the platform 40. In the event of brush seal failure, the labyrinth teeth 50 provide a backup seal. It will be appreciated that the labyrinth teeth may project from the web 22 on either or both axial sides of the brush seal for sealing with the platform 40.

In addition, as illustrated in FIG. 1, the buckets of the wheels downstream of the platform 40 have upstream projecting flanges 52. The flanges 52 form an annular sealing surface 53 about the rotor shaft and similarly as the flanges 44, portions of the wheelspace 46 are disposed radially between the flanges and the rotor surface 36. The flange 52 also lies in radial registration with the web 22. One or more labyrinth teeth 56 project from the web 22 and terminate short of the annular outer sealing surface 53 of flanges 52 forming a further labyrinth tooth backup seal to the brush seal 26. Because of the sealing area's symmetry about the rotor wheels, axial effects on the rotor thrust in the event of brush seal failure are mitigated.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A steam turbine comprising:

a rotatable component including a rotor shaft and a non-rotatable component about said rotatable component;

a brush seal carried by said non-rotatable component for sealing engagement with the rotatable component;

first and second wheels on said rotatable component spaced axially from one another;

said rotatable component including a plurality of buckets spaced circumferentially from one another on each of said wheels;

means for inhibiting non-uniform circumferential heat transfer to the rotatable component thereby to eliminate or minimize bow of the rotatable component due to frictional contact between the brush seal and the rotatable component;

said inhibiting means including an annular platform projecting radially outwardly of an outer surface of and from said rotor shaft at an axial location between said first and second wheels;

flanges extending axially from the buckets on said second wheel in a direction toward said platform and said first wheel and spaced radially outwardly of the outer surface of the rotor shaft;

said brush seal disposed between said buckets and engaging a sealing surface on said platform radially outwardly of said outer surface; and at least one labyrinth seal tooth extending between said stationary component and said bucket flanges.

2. A turbine according to claim 1 wherein the space between the rotating component and the stationary component defines a leakage flow path, said brush seal being located upstream of said labyrinth tooth in said flow path.

3. A turbine according to claim 1 wherein said platform includes an annular extending pedestal having a neck and at least one flange extending in a direction toward said first wheel and away from said neck, said sealing surface being located on said platform flange.

4. A turbine according to claim 1 wherein said non-rotatable component has a diaphragm with an inner web spaced radially outwardly of said platform and in radial registration therewith, said brush seal extending from said web to engage said platform and along a surface thereof spaced axially and radially from the neck of said pedestal.

5. A turbine according to claim 1 wherein said non-rotatable component has a diaphragm with an inner web spaced radially outwardly of said bucket flanges and in radial registration therewith, said labyrinth tooth extending from said web toward said bucket flanges and terminating short of said bucket flanges.

6. In a steam turbine having a rotatable component including a rotor shaft mounting axially spaced buckets and a non-rotatable component about the rotatable component carrying a brush seal for sealing engagement with the rotatable component, a method of substantially eliminating bowing of the rotor resulting from circumferentially non-uniform distribution of heat about the rotatable component due to frictional contact between the brush seal and the rotatable component comprising the steps of:

inhibiting circumferential non-uniform heat transfer to the rotatable component resulting from heat generated by frictional contact between the rotatable component and the brush seal by locating the brush seal radially outwardly of said rotor shaft for sealing a steam leakage path between the rotatable and non-rotatable components;

providing upstream directed flanges on the buckets downstream of the brush seal and radially outwardly of the rotor shaft; and locating a labyrinth seal on said non-rotatable component for sealing cooperation with a sealing surface on said flanges at substantially the same radial distance from the shaft as said brush seal.

7. A method according to claim 6 including locating the brush seal in a wheelspace between the axially spaced buckets.

8. A method according to claim 7 including locating said sealing surface on a flange extending axially downstream of said pedestal.

9. A method according to claim 8 including locating a second labyrinth seal between said non-rotatable component and said pedestal at an axial location downstream of said brush seal and at a substantially like radial distance from the shaft as said brush seal.

10. A method according to claim 6 including providing an annular pedestal projecting radially outwardly of said rotor shaft having a sealing surface and engaging the brush seal along the sealing surface.

* * * * *